US005743617A

United States Patent [19]

Sato et al.

[11] Patent Number: 5,743,617

[45] Date of Patent: Apr. 28, 1998

[54] VEHICULAR LAMP

[75] Inventors: Osamu Sato; Hiroshige Shinkai; Kihachirou Uchida, all of Shizuoka, Japan

[73] Assignee: Koito Manufacturing Co., Ltd., Tokyo, Japan

[21] Appl. No.: 587,713

[22] Filed: Jan. 19, 1996

[30] Foreign Application Priority Data

Jan. 20, 1995 [JP] Japan ..... 7-006895

[51] Int. Cl.[6] ..... H01R 33/00

[52] U.S. Cl. ..... 362/61; 362/226; 439/619; 439/856; 248/231.91

[58] Field of Search ..... 439/617, 619, 439/692, 736, 856, 885; 362/61, 80, 226, 310; 313/318.05, 318.06, 318.12; 248/56, 231.91

[56] References Cited

U.S. PATENT DOCUMENTS 4,618,205 10/1986 Freeman ..... 439/692
4,720,272 1/1988 Durand ..... 439/619
4,794,500 12/1988 Bradley ..... 362/226
4,814,959 3/1989 Chakrabarti et al. ..... 362/61
4,868,722 9/1989 Haraden ..... 362/80
4,871,331 10/1989 Kondo et al. ..... 439/736
5,041,006 8/1991 Van Zanten et al. ..... 439/856
5,452,512 9/1995 Foley et al. ..... 439/885

FOREIGN PATENT DOCUMENTS 39 16 443 A1 8/1990 Germany .

*Primary Examiner*—Alan Cariaso
*Attorney, Agent, or Firm*—Sughrue, Mion, Zinn, Macpeak & Seas, PLLC

[57] ABSTRACT

A vehicular lamp which includes a lamp body and a wedge-base bulb which connects to a lead wire, in which a base member of the wedge-base bulb is held by contact holding pieces of a contact terminal which is securely held by the lamp body and penetrates the lamp body in the front-rear direction thereof, so that the wedge-base bulb is mounted on a front surface of the lamp body, and the lamp is characterized in that the contact terminal is of a box-type and formed integrally with the lamp body.

26 Claims, 7 Drawing Sheets

VEHICULAR LAMP

BACKGROUND OF THE INVENTION

1. Field of the Invention

The present invention relates to a vehicular lamp employing a wedge-base bulb as a light source.

2. Related Art

There has been known conventional vehicular lamps of this type as disclosed, for example, in Unexamined Japanese Utility Model Application No. Sho. 56-135682. FIG. 11 is a sectional view of the conventional vehicular lamp.

As shown in Fig. 11, the conventional front turn signal lamp is provided with a lamp body 1 having thereon a socket section 1*a*. A contact terminal 3 securely engages with a terminal engaging hole 2 formed in the socket section 1*a*. A wedge base bulb 4 is mounted in and held by the socket section 1*a* of the lamp body 1 in such a manner that a base section 4*a* of the wedge base bulb 4 is held by a couple of plate spring-like contact hold pieces 3*a* and 3*b* of the contact terminal 3, which pieces protrude inward the socket section 1*a*.

With the structure of the conventional lamp, it is not necessary to prepare a socket for receiving the contact terminal 3 separately from the lamp body 1 but, instead, the contact terminal 3 engages directly with a part, i.e., the socket section 1*a*, of the lamp body 1. Accordingly, the vehicular lamp can be made simple in structure.

However, the structure of the conventional vehicular lamp as described above requires, for example, that the terminal engaging hole 2 is formed with a step portion to engage with the contact terminal 3 whereas the contact terminal 3 is formed with a cut-and-rise part to engage with the step portion of the terminal engaging hole 2. In other words, the conventional structure requires an extra means disposed between the contact terminal 3 and the terminal engaging hole 2 for positioning the contact terminal and for preventing the same from detaching, thereby making the lamp be complicated in structure.

Further, in the conventional structure, the contact terminal 3 for supporting the bulb 4 engages with the terminal engaging hole 2 merely loosely, and the contact hold pieces 3*a* and 3*b* of the contact terminal 3 must be supported by the socket section 1*a* of the lamp body 1 to securely hold the base section 4*a* of the wedge base bulb 4. For this reason, since an inner wall of the socket section 1*a* of the lamp body 1 must be located close to the bulb 4 in anyway, the conventional structure suffers from a problem that the lamp body 1 may readily be deformed due to heat generating from the bulb or otherwise only a special material having a high heat resistivity must be employed as a material of the lamp body 1.

Furthermore, because the contact terminal 3 engages with the terminal engaging hole 2 formed in the lamp body 1, water or moisture may enter the lamp chamber through the terminal engaging hole 2, which causes a problem.

SUMMARY OF THE INVENTION

The present invention was made in view of the foregoing problems and difficulties accompanying the conventional vehicular lamp employing the wedge base bulb. Accordingly, an object of the present invention is to provide a vehicular lamp employing a wedge base bulb which can be manufactured simple in structure and capable of suppressing the problems due to heat applied to the lamp body and improving the water-resistivity at the back surface of the lamp body.

The above and other objects can be achieved by a provision of a vehicular lamp which, according to a first aspect of the present invention, includes a lamp body and a wedge-base bulb which connects to a lead wire, and a base section of the wedge-base bulb is held by a contact holding piece of a contact terminal which is securely held by the lamp body and penetrates the lamp body in the front-rear direction thereof, so that the wedge-base bulb is mounted on a front surface of the lamp body, and the lamp is characterized in that the contact terminal is molded integrally with the lamp body.

According to a second aspect of the invention, in the vehicular lamp having the structure of the first aspect of the invention as described above, the contact holding piece for holding the base member of the wedge-base bulb, which protrudes frontward of the lamp body, is formed in the box-like terminal structure having a high mechanical rigidity.

According to the first aspect of the invention, because the contact terminal for supporting the wedge-base bulb is formed integrally with the lamp body, the contact terminal can be secured affirmly to the lamp body without necessity of a provision of any positioning member or detach preventing member between the contact terminal and the lamp body.

Since the contact terminal can be secured affirmly to the lamp body, only the contact holding piece of the contact terminal is required for securely holding the bulb and, accordingly, it is not necessary to support the contact terminal by the inner wall of the lamp body as required in the conventional structure.

Further, since there is no gap at the portion where the contact terminal penetrates, there is no possibility that water or moisture enters the lamp chamber.

According to the second aspect of the invention, since the contact holding piece for holding the bulb base section is formed in the box-like terminal structure having a high mechanical rigidity, the bulb can be securely supported without supporting the contact holding piece by the wall surface of the lamp body.

DESCRIPTION OF THE PREFERRED EMBODIMENTS

The present invention will now be described in detail with reference to accompanying drawings.

Figure 1:
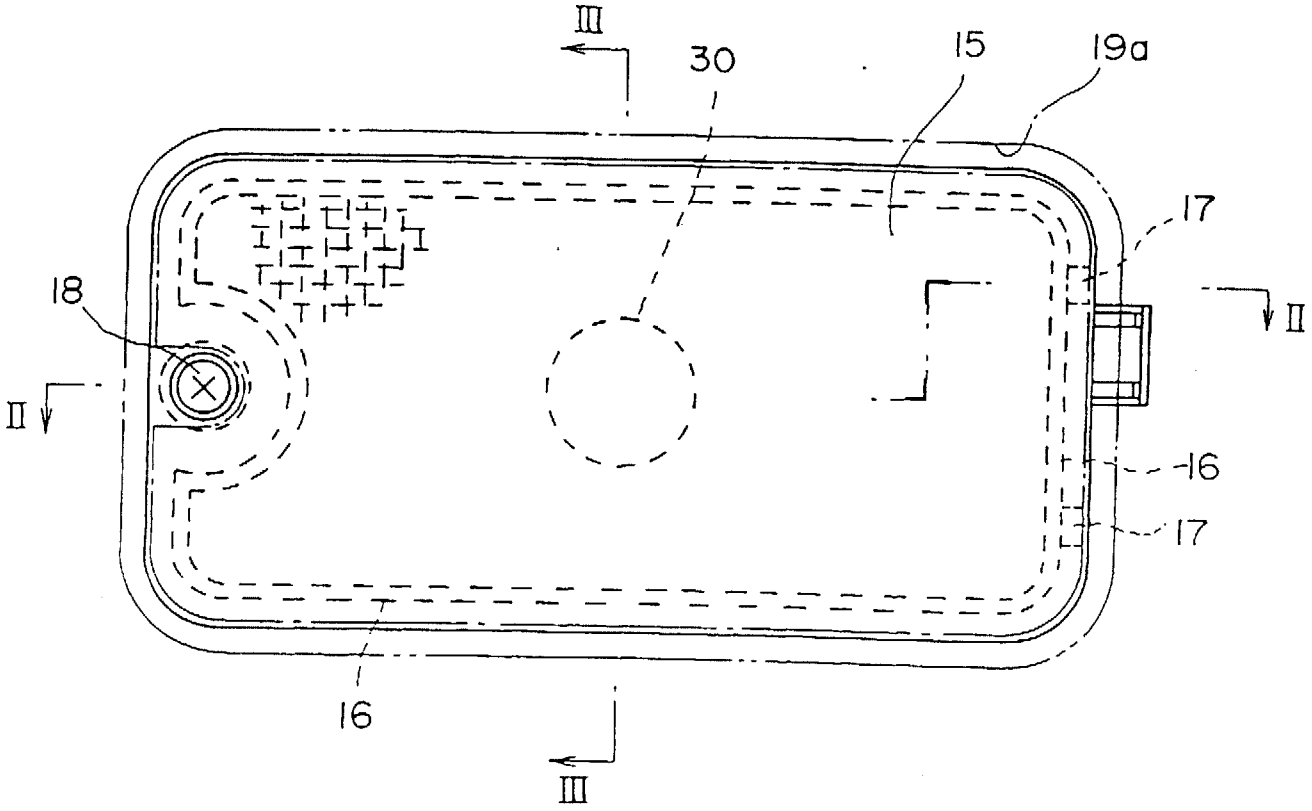
FIG. 1 is a plan view showing a front turn signal lamp for vehicles according to one embodiment of the present invention.
Figure 2:
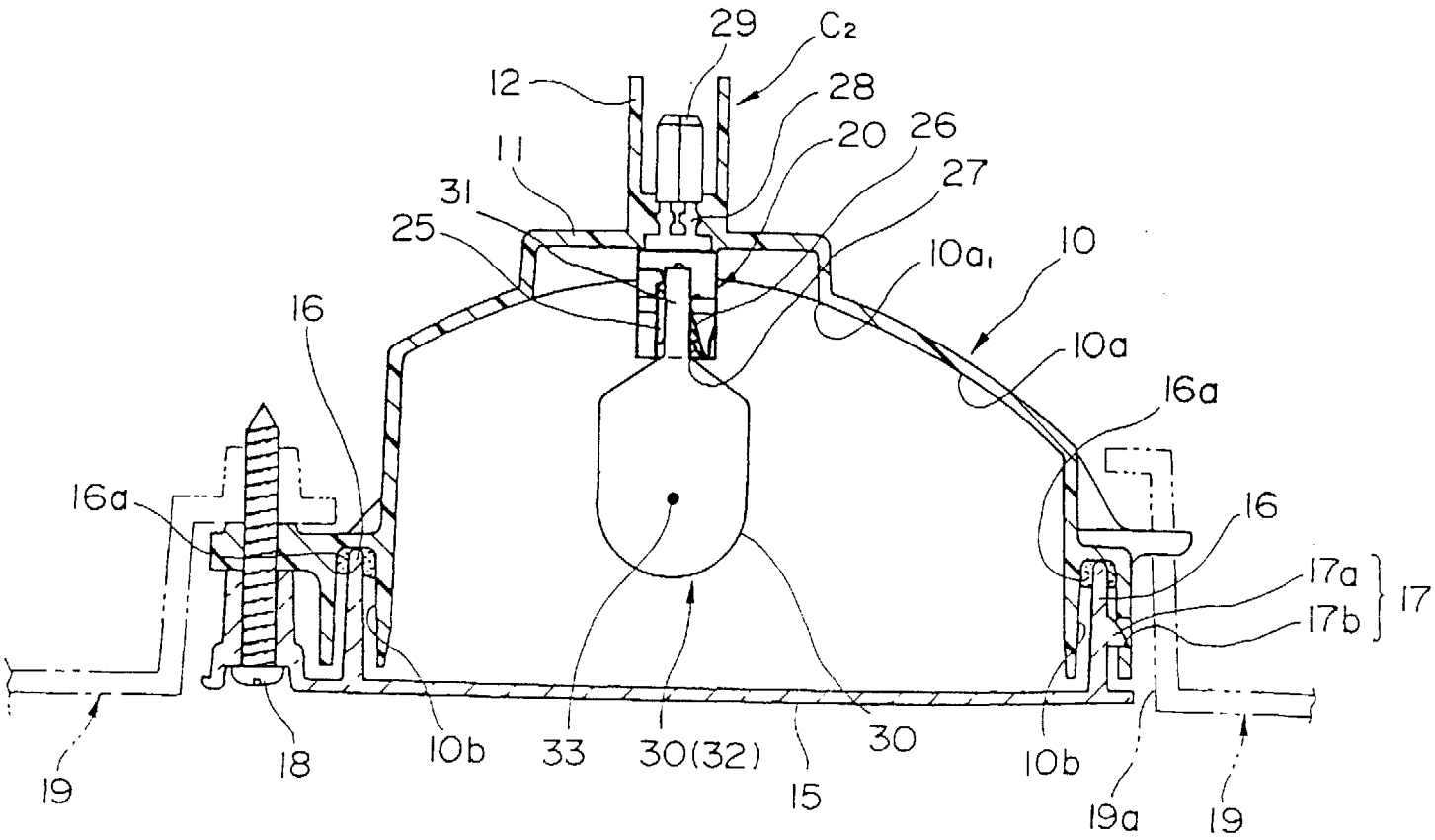
FIG. 2 is a horizontal sectional view of the front turn signal lamp cut along lines II—II of FIG. 1.
Figure 3:
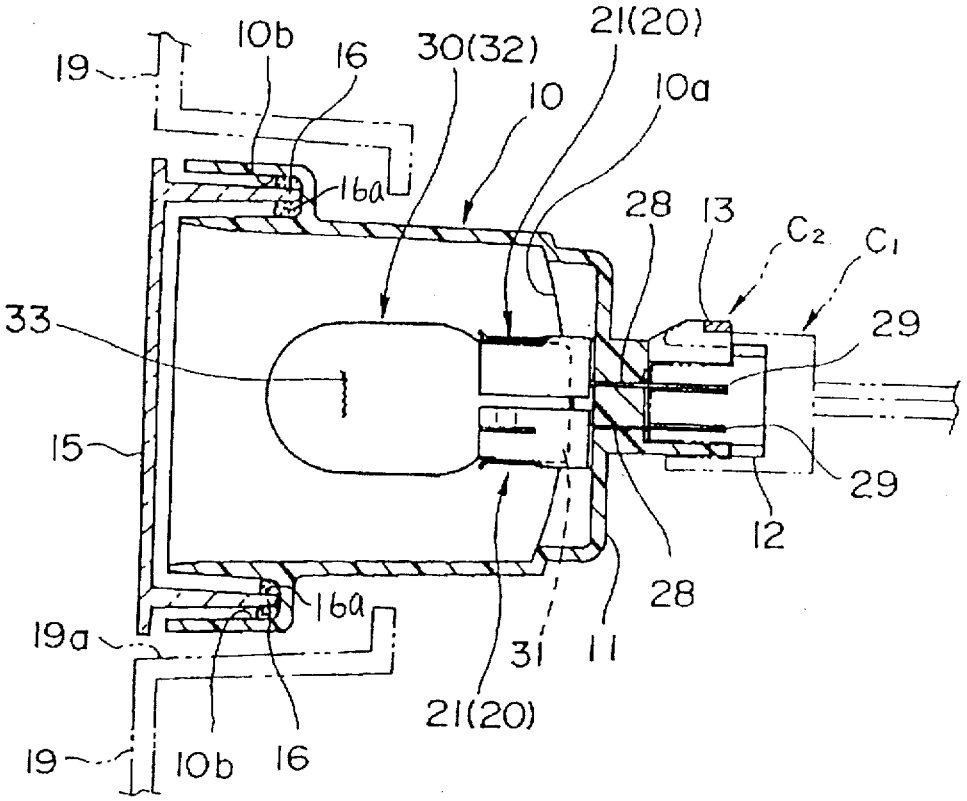
FIG. 3 is a vertical sectional view of the front turn signal lamp cut along lines III—III of FIG. 1.
Figure 4:
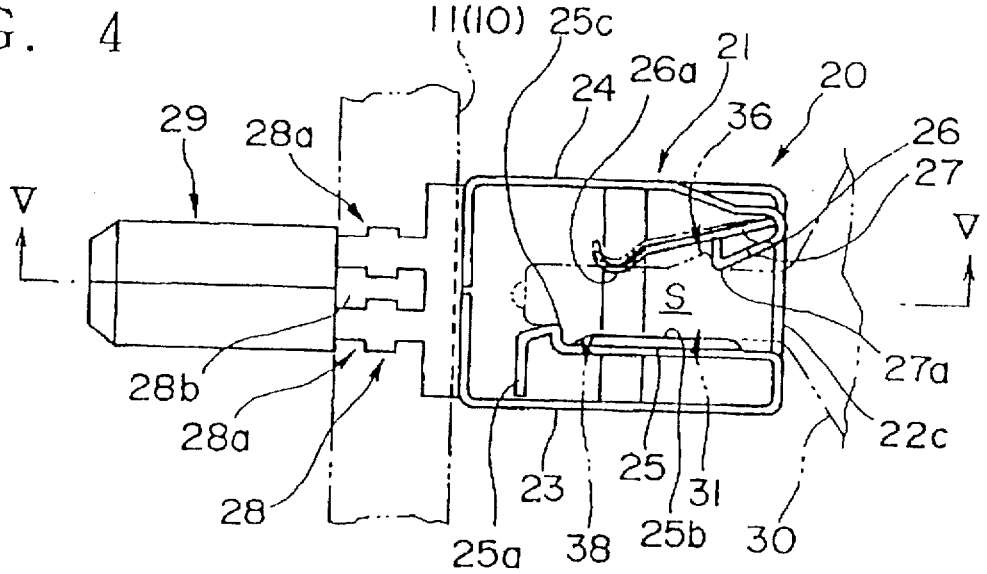
FIG. 4 is an enlarged plan view of a contact terminal according to the invention.
Figure 5:
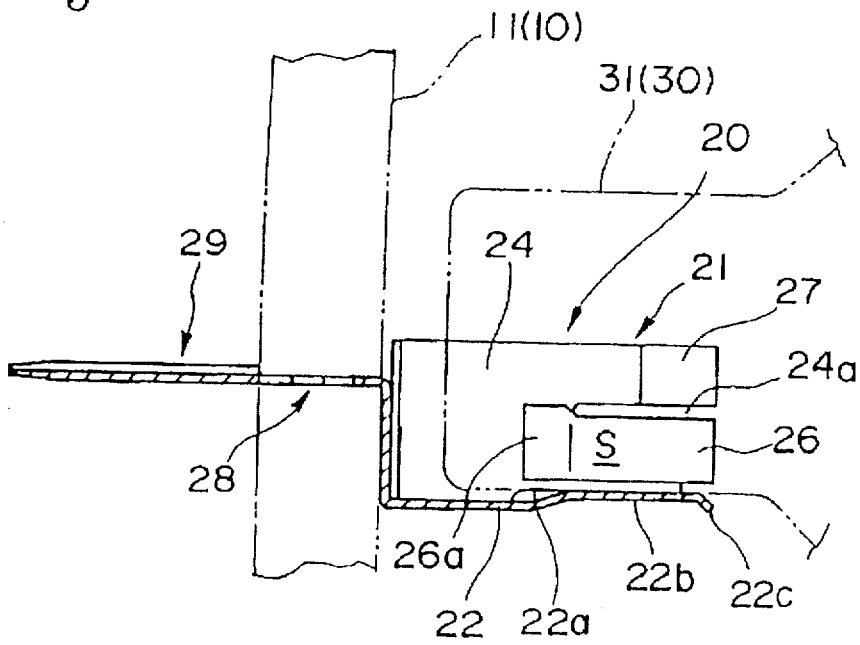
FIG. 5 is an enlarged vertical sectional view of the contact terminal cut along lines V—V of FIG. 4.
Figure 6:
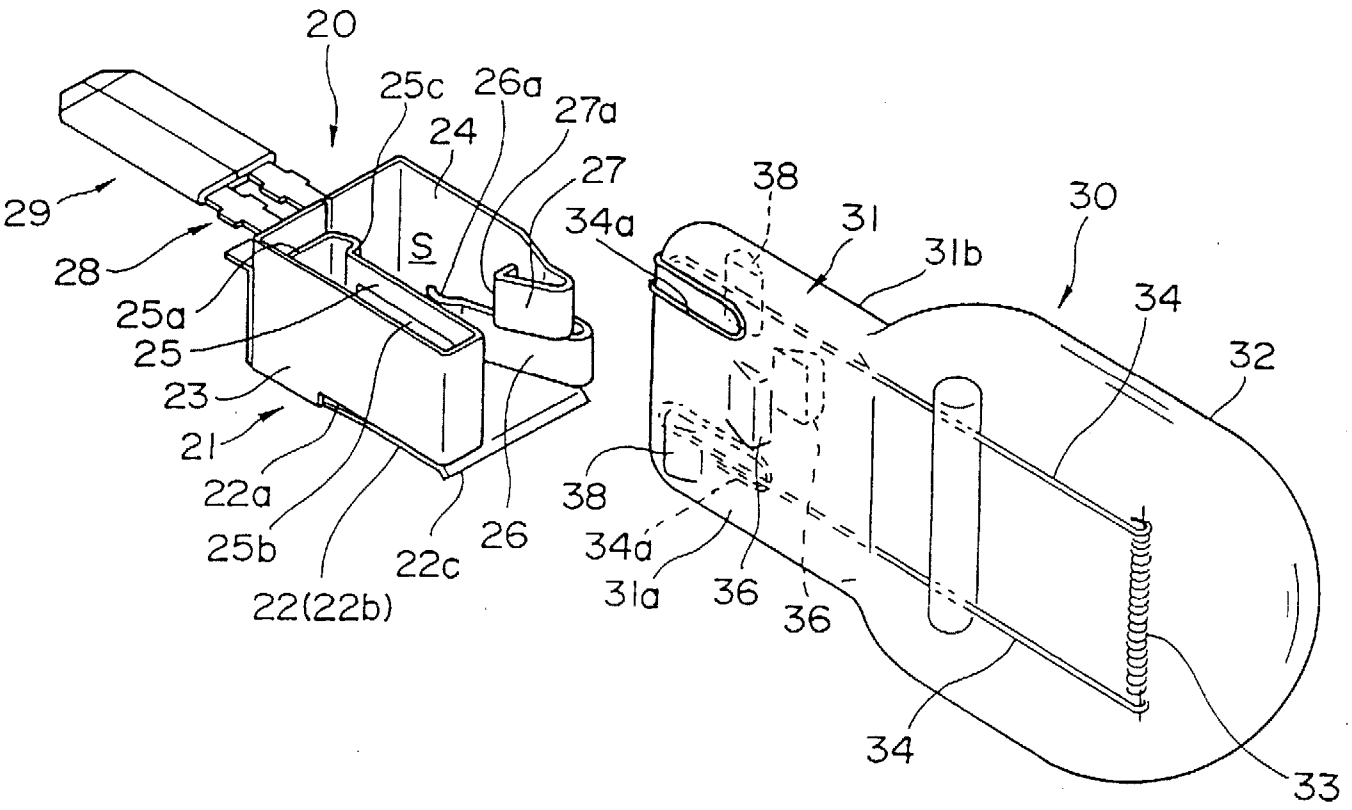
FIG. 6 is a perspective view for explaining the holding operation of the wedge-base bulb with using a contact holding piece of the contact terminal.
Figure 7:
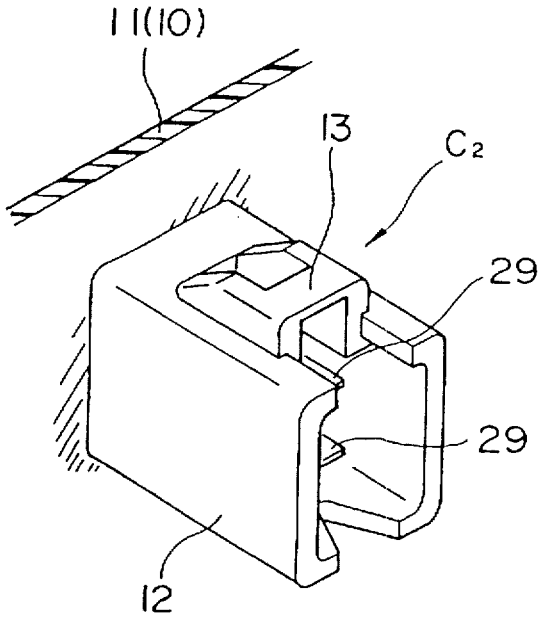
FIG. 7 is a perspective view of a connector of the bulb side formed integrally with the lamp body.
Figure 8:
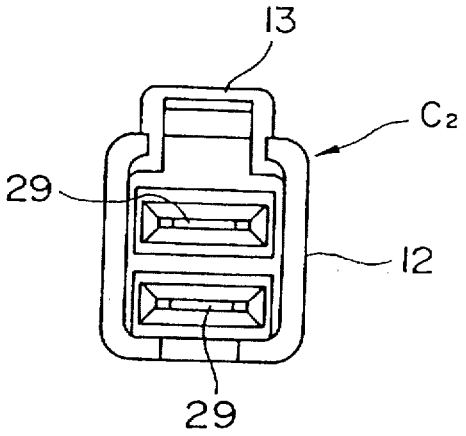
FIG. 8 is a front view of the connector of the invention shown in FIG. 7.
Figure 9:
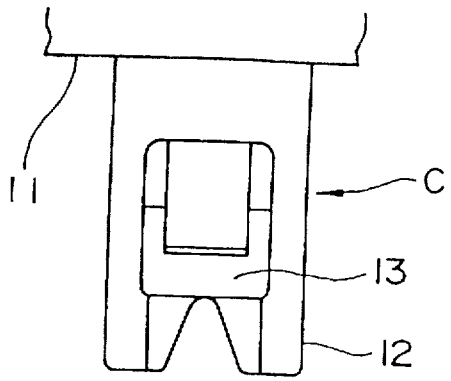
FIG. 9 is a plan view of the connector shown in FIG. 7.
Figure 10:
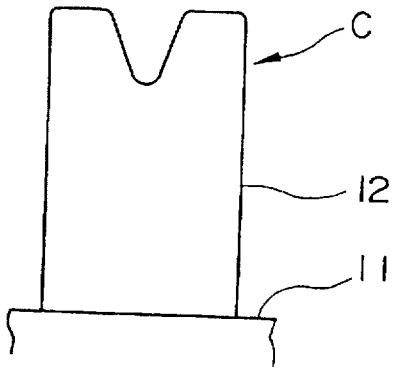
FIG. 10 is a bottom view of the connector shown in FIG. 7.
Figure 11:
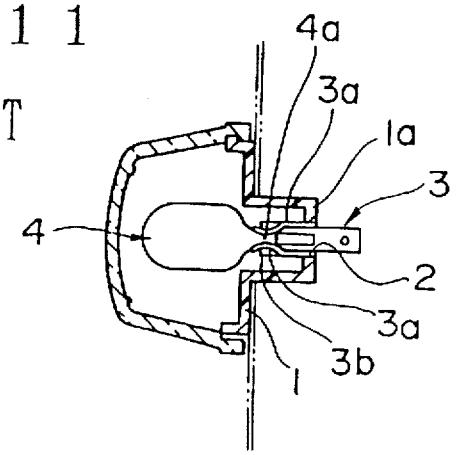
FIG. 11 PRIOR ART
FIG. 11 is a sectional view of a conventional lamp.

FIGS. 1 through 10 show a front turn signal lamp for vehicles according to one embodiment of the present invention. More specifically, FIG. 1 is a plan view showing a front turn signal lamp for vehicles according to one embodiment of the present invention. FIG. 2 is a horizontal sectional view of the front turn signal lamp cut along lines II—II of FIG. 1. FIG. 3 is a vertical sectional view of the front turn signal lamp cut along lines III—III of FIG. 1. FIG. 4 is an enlarged plan view of a contact terminal according to the invention. FIG. 5 is an enlarged vertical sectional view of the contact terminal cut along lines V—V of FIG. 4. FIG. 6 is a perspective view for explaining the holding operation of the wedge-base bulb with using a contact holding piece of the contact terminal. FIG. 7 is a perspective view of a connector of the bulb side formed integrally with the lamp body. FIG. 8 is a front view of the connector of the invention shown in FIG. 7. FIG. 9 is a plan view of the connector shown in FIG. 7, and FIG. 10 is a bottom view of the connector shown in FIG. 7.

As shown in these figure drawings, a vessel-like lamp body 10 is formed of a synthetic resin, and a couple of box-like terminal members 21, 21, which is a part of a couple of contact terminals 20, 20, for mounting therein a bulb are disposed in front of a back wall of the lamp body 10 in such a manner that the terminal members 21, 21 are arranged up and down in parallel to each other and opening sides of which face each other. The contact terminal 20 is formed integrally with the lamp body 10 thereby being secured integrally to the back wall of the lamp body 10. A wedge-base bulb 30 is inserted in between the couple of terminal members 21, 21 protruding frontward of the back wall of the lamp body.

The back wall of the lamp body 10 is substantially palaboloidal and an inner peripheral surface 10*a* of which may be coated with silver color when desired. The back wall of the lamp body 10 is formed at a rear peak thereof with a plane region 11 expanding rearwardly. The terminal member 21 serving as a contact holding piece extends largely frontward from the plane region 11 over a peripheral edge $\mathbf{10}a_1$ of the inner peripheral surface 10*a* of the lamp body 10 at the plane region 11 side thereof. A base section 31 of the wedge-base bulb 30 is inserted in the terminal member 21. That is, the bulb 30 is supported only by the couple of terminal members 21 of the contact terminals 20 without being supported by the inner wall of the lamp body as required in the conventional structure. Therefore, since the inner wall of the lamp body 10 is sufficiently spaced apart from the bulb 30 performing as a heat generation source, the lamp body 10 is not deformed due to heat generating from the bulb.

At the back surface of the lamp body 10, a rectangular-cylinder shaped terminal receptacle 12 extends backward from the plane region 11 of the lamp body 10. As shown in FIGS. 3, 7 and 8, a couple of male contact pieces 29, 29, which are a part of the contact terminals 20, 20 and arranged up and down and in parallel with each other, project in the terminal receptacle 12. The male contact pieces 29, 29 form a part of a bulb side connector $C_2$ engaging with a power supply side connector $C_1$. An engaging member 13 of the terminal receptacle 12 engages with a hook formed on the power supply connector $C_1$ to thereby preventing the connector $C_1$ from detaching.

An amber-colored front lens 15 formed of synthetic resin is formed with Fresnel lens steps on a rear surface thereof and convex fish-eye lens steps on a front surface thereof. Owing to the structure, light beam emitting from the bulb 30 is collimated by the Fresnel lens steps formed on the rear surface of the front lens 15 and then diffused in vertical and horizontal directions by the convex fish-eye lens steps formed on the front surface thereof.

The front lens 15 is also provided with a seal leg 16 protruding from an outer periphery of the rear surface thereof, and the seal leg 16 fits in a seal groove 10*b* formed on the opening periphery of the lamp body 10, so that the front lens 15 is assembled on the lamp body 10. As shown in FIGS. 2 and 3, a sealant 16*a* is applied between the seal groove 10*b* and the seal leg 16 for sealing the engagement section of the seal leg 16 with the seal groove 10*b*. However, the sealant 16*a* is not necessarily injected between the seal leg 16 and the seal groove 10*b*, instead, other way or material may also be applicable if the sealing between the between the seal leg 16 and the seal groove 10*b* is accomplished.

A convex-concavo engaging lance 17 for connecting one side of the front lens 15 to the lamp body 10 is constituted by a projection 17*a* formed on the seal leg 16 of the front lens 15 and an engagement hole 17*b* formed on the outer wall of the seal groove 10*b*. The other side of the front lens 15 is secured to the lamp body 10 by a screw 18. The front lens 15 is thus assembled on the lamp body 10 cooperatively by the convex-concavo engaging lance 17 and the screw 18. The screw 18 also serves to secure the front turn-signal lamp to the front bumper 19 of the vehicle body, through a lamp mounting opening 19*a* formed at a predetermined position of the vehicle bumper 19.

On the other hand, the wedge-base bulb 30 is provided, as shown in an enlarged view of FIG. 6, with a glass tube 32, a filament 33, a pair of lead wires 34, 34 for supporting both ends of the filament 33, and the lead wires 34, 34 extend out of a bulb base section 31 which is pinch-sealed and substantially rectangular in cross section. An end of each lead wires 34, 34 extending out of the bulb base section 31 is bent along left and right side surfaces 31*a*, 31*b* of the bulb base section 31 and exposed outside. Therefore, when the bulb base section 31 is mounted to the terminal member 21 of the contact terminal 20, the exposed lead wire 34*a* electrically connects to the terminal member 21 to thereby maintaining the conductive condition of the lead wire 34 with the contact terminal 20. As described in more detail hereinafter, at the left and right side surfaces 31*a*, 31*b* of the bulb base section 31, there are provided a detach preventing rib 36 and a positioning rib 38 which engage with claws 27*a* and 25*c*, respectively, of the terminal members 21.

As shown in FIGS. 4, 5 and 6 which are enlarged views, the contact terminal 20 is formed by bending a metal thin plate which is previously cut out to have a predetermined configuration. The contact terminal 20 is provided with a box-like terminal member 21 for engaging with the bulb base section 31, a male contact piece 29 projecting toward a back wall surface side of the lamp body 10 and serving as a part of the bulb side connector $C_2$ engaging with the power supply side connector $C_1$, and a lamp body securing section 28 disposed between the box-like terminal member 21 and the male contact piece 29 for integrally securing to the lamp body 10.

With the structure, the lamp body securing section 28 is integrally secured to the back wall of the lamp body 10 by integrally molding the contact terminal 20 with the lamp body 10, that is, by molding the lamp body 10 while the contact terminal 20 is inserted in a mold die for molding the lamp body. The box-like terminal member 21 for receiving the wedge-base bulb 30 is disposed at a front side of the lamp body 10 while disposing at the back side thereof the bulb side connector $C_2$ having a cylindrical terminal receptacle 12 in which the male contact pieces 29 project as shown in FIGS. 7 and 8.

According to the structure of the embodiment as described above, since the contact holding piece is formed by the box-like terminal member 21 having a high mechanical rigidity, and the bulb base section 31 of the wedge-base bulb 30 is held by the box-like terminal member 21, the wedge-base bulb 30 can be securely supported by holding the bulb base section 31 by the contact terminal 20 without supporting the contact holding pieces by the wall surface of the lamp body as required in the conventional structure. Further, since the terminal 21 is of a box type, the mold die for molding the lamp body can readily be machined. Specifically, it is easy to machine the mold die to form a recess for closely receiving the contact terminal 20.

As described above, the terminal member 21 connecting continuously to the lamp body fixing section 28 is formed in a box shape with a bottom plate 22 which is L-shaped in vertical cross section and a couple of left and right flat side plates 23, 24 extending vertically from the bottom plate 22 for holding the left and right side surfaces 31*a*, 31*b* of the bulb base section 31 of the bulb 30. A rear half part of each of the left and right flat side plates 23, 24 is bent inward to overlap the bottom plate 22 to thereby enhance the mechanical rigidity of the terminal member 21. Further, a slit 22*a* is defined between the bottom plate 22 and the left and right flat side plates 23, 24, so that a front half part 22*b* of the bottom plate 22 is slightly bent up inwardly and the front half parts of each of the left and right flat side plates 23, 24 are bent back inwardly, to thereby define a bulb receiving chamber S in the terminal member 21.

Owing to the structure, the front half part 22*b* of the bottom plate 22, which performs as a plate spring, holds a top and bottom surfaces 31*c*, 31*d* of the bulb base section 31 of the bulb 30 which is inserted in the bulb receiving chamber S.

A tip end 25*a* of a bent-back piece 25 of the one flat side plate 23 is further bent to contact to the flat side plate 23, so that the side surface 31*a* of the bulb base section 31 can be held without elastically deforming the bent-back piece 25 when the bulb base section 31 is inserted in the bulb receiving chamber S. A rib 25*b* extending in the front-rear direction is formed on the bent-back piece 25 for reinforcing the rigidity of the bent-back piece 25 so that the side surface 31*a* of the bulb base section 31 of the bulb 30 can securely be held. The reinforcing rib 25*b* protrudes into the bulb receiving chamber S and performs also as a guide member for the bulb base section 31 when it is inserted in the bulb receiving chamber S.

A claw 25*c* formed at the inner end position, that is, at the deep position of the bulb receiving chamber S, of the bent-back piece 25 of the flat side plate 23, is bent to protrude inward of the bulb receiving chamber S for limiting the inserting amount for the bulb. When the bulb base section 31 of the wedge-base bulb 30 is inserted in the bulb receiving chamber S of the terminal member 21, the positioning rib 38 formed on the bulb base section 31 comes into abutment against the claw 25*c* and, hence, the insertion amount of the bulb base section 31 into the terminal member 21 is set to be defined by the abutment of the rib 38 against the claw 25*c*.

On the other hand, as best shown in FIG. 6, a tip end part of the other flat side plate 24 is divided into upper and lower pieces 26, 27 by a slit 24*a* extending in the front-rear direction, both of which are bent back to have a predetermined angle with the side plate 24 so that tip ends of the bent-back pieces come closer to the opposite flat side plate 23.

The lower bent-back piece 26 is provided at a distal end thereof with an arcuate pressing section 26*a* which protrudes into the bulb receiving chamber S. When the bulb base section 31 is inserted in the bulb receiving chamber S, the pressing section 26*a* urges the side surface 31*b* of the bulb base section 31, so that the bulb base section 31 is held cooperatively by the pressing section 26*a* and the bent-back piece 25 of the opposite flat side plate 23 and, also, the pressing section 26*a* comes into contact to and becomes conductive with the exposed lead wire 34*a* of the bulb base section 31.

Further, the upper bent-back piece 27 is provided at a distal end thereof with a claw 27*a*. When the bulb base section 31 is inserted in the bulb receiving chamber S, the upper bent-back piece 27 is resiliently deformed to allow the detach preventing rib 36 protruding from the bulb base section 31 to pass therethrough and thereafter engage with the rib 36 to prevent the bulb base section 31 from detaching. The claw 27*a* of the upper bent-back piece 27 also serves to hold the bulb base section 31 cooperatively with the bent-back piece 25 of the opposite flat side plate 23 as similar to the pressing section 26*a* of the lower bent-back piece 26.

As described above, the left and right side plates 23 and 24 for defining the bulb receiving chamber S are both bent inwardly in the bulb receiving chamber S and the tip ends of the both bent back pieces are further bent outwardly, so that the bulb base section 31 can smoothly be inserted into and detached from the bulb receiving chamber S. Further, since a front edge 22*c* of the bottom plate 22 is bent outward of the bulb receiving chamber S, the bottom plate 22 does not interfere with the bulb base section 31 when it is inserted into and detached from the bulb receiving chamber S.

As shown in FIG. 4, the lamp body fixing section 28 is notched at two portions at left and right outer periphery thereof as indicated by reference numeral 28*a*, and a cut-out 28*b* is defined in the fixing section 28 at a center in the widthwise direction thereof. When the lamp body 10 is molded with the contact terminal 20, resin is introduced in the cut-out 28*b*, so that the lamp body fixing section 28 is integrally molded with the back wall of the lamp body.

The male contact piece 29 has a double layer structure which is formed by bending inwardly the left and right outer edge portions in the widthwise direction of the male contact piece forming region. This structure improves the mechanical rigidity of the contact piece 29 which is inserted in and detached from the power supply side connector $C_1$.

As described above, according to the vehicular lamp of the present invention, the contact terminal for supporting the wedge base bulb is securely fixed to the lamp body because it is integrally molded with the lamp body. Therefore, it is not required to form a hole for engaging the contact terminal with the lamp body as required in the conventional structure or to provide any positioning member or detach preventing member between the contact terminal and the lamp body. For the reason, the lamp can be manufactured very simple in structure.

Furthermore, since the contact terminal is secured to the lamp body, the wedge base bulb can be held merely by the contact holding piece of the contact terminal. For the reason, the lamp body can be prevented from being affected by heat generating from the bulb merely by appropriately positioning the contact terminal in such a manner that the wedge base bulb is spaced sufficiently apart from the inner wall of the lamp body. Thus, many different materials can be selected for the lamp body.

Moreover, since there is no gap at the portion where the contact terminal penetrates, there is no possibility that water or moisture enters the lamp chamber.

According to the other aspect of the present invention, since the contact holding piece for holding the bulb base member is formed in the box-like terminal structure having a high mechanical rigidity, the bulb can be securely supported without supporting the contact holding piece by the wall surface of the lamp body.

Further, since the terminal is of a simple box type, the mold die for molding the lamp body can readily be machined. Specifically, it is easy to machine the mold die to form a recess for closely receiving the contact terminal 20.

It should be understood that the form of the invention herein shown and described is to be taken as a preferred example of the invention and that various changes in the shape, size and arrangement of parts may be resorted to without departing from the spirit of the invention or the scope of the subjoined claims. For example, the cylindrical member may be circular, rectangular, or polygonal in cross section.

What is claimed is:

1. A vehicle lamp comprising:

a vessel-like lamp body formed of a synthetic resin;

a front lens coupled with a front opening of said lamp body to define a lamp chamber; and a wedge base bulb disposed in said lamp chamber;

a contact terminal secured to said lamp body at a back wall thereof, said contact terminal holding said bulb and electrically connecting therewith, said contact terminal being integrally molded with said lamp body;

a connector connecting between said contact terminal and a power source; and wherein said contact terminal comprises a box-like terminal member, a male contact piece projecting toward a back wall surface side of said lamp body, and a lamp body securing section disposed between said box-like terminal member and said male contact piece, said lamp body securing section is integrally secured to said lamp body.

2. The vehicular lamp according to claim 1, wherein said contact terminal is formed by bending a metal thin plate which is previously cut out to have a predetermined configuration.

3. The vehicular lamp according to claim 1, wherein said male contact piece has a double layer structure which is formed by bending inwardly each of a left and a right outer edge portion in a widthwise direction of the male contact piece forming region.

4. A vehicular lamp comprising: a vessel-like lamp body formed of a synthetic resin;

a front lens coupled with a front opening of said lamp body to define a lamp chamber; and a wedge base bulb disposed in said lamp chamber;

a contact terminal secured to said lamp body at a back wall thereof, said contact terminal holding said bulb and electrically connecting therewith, said contact terminal being integrally molded with said lamp body;

a connector connecting between said contact terminal and a power source; and wherein said contact terminal comprises a box-like terminal member, a male contact piece projecting toward a back wall surface side of said lamp body, and a lamp body securing section disposed between said box-like terminal member and said male contact piece, said lamp body securing section is integrally secured to said lamp body wherein said box-like terminal member has a front part and rear part and comprises a bottom plate which is L-shaped in vertical cross section, and a first and second flat side plates extending orthogonally from said bottom plate, said side plates holding first and second surfaces of a bulb base section of said bulb when said bulb is inserted at said front portion, and a rear half part of each of said flat side plates is bent inward to overlap said bottom plate and form a rear wall.

5. The vehicular lamp according to claim 4, wherein a slit is defined between said bottom plate and said first and second flat side plates, so that a front half part of said bottom plate is slightly bent up inwardly and a front half part of each of said first and second flat side plates is bent back inwardly to form a first and a second bent back piece, respectively, and to define a bulb receiving chamber.

6. The vehicular lamp according to claim 5, wherein a tip end of said first bent-back piece of said first flat side plate is further bent to contact to said flat side plate.

7. The vehicular lamp according to claim 6, wherein said first bent-back piece of said first flat side plate comprises a rib extending in the front-rear direction, and said rib protrudes into said bulb receiving chamber.

8. The vehicular lamp according to claim 5, wherein said first flat side plate comprises a claw formed at an inner end position of said first bent-back piece of said first flat side plate, and said claw is bent to protrude inward of said bulb receiving chamber.

9. The vehicular lamp according to claim 4, wherein a tip end part of said second flat side plate is divided relative to said bottom plate into upper and lower pieces by a slit extending in the front-rear direction of the lamp, each of said upper and lower pieces is bent back to have a respective predetermined angle with said second side plate so that tip ends of the bent-back pieces come closer to said first flat side plate.

10. The vehicular lamp according to claim 9, wherein said lower bent-back piece comprises at a distal end thereof an arcuate pressing section which protrudes into said bulb receiving chamber.

11. The vehicular lamp according to claim 9, wherein said upper bent-back piece comprises at a distal end thereof a claw engaging with said bulb.

12. The vehicular lamp according to claim 1, wherein said lamp body securing section of said contact terminal is notched at two portions at left and right outer periphery thereof, and a cut-out is defined in said securing section at a center of said securing section and in the widthwise direction thereof.

13. A contact terminal for a vehicular lamp in which a wedge base bulb is held by and electrically connects to the contact terminal, the contact terminal comprising:

a box-like terminal member;

a male contact piece projecting toward a back wall surface side of a lamp body; and a lamp body securing section disposed between said box-like terminal member and said male contact piece, said lamp body securing section having a portion projecting in a direction transverse to the direction of said male contact piece's projection towards a back wall surface side of the lamp body.

14. The contact terminal according to claim 13, wherein said lamp body securing section is integrally molded with said lamp body.

15. The contact terminal according to claim 13, wherein said contact terminal is formed by bending a metal thin plate which is previously cut out to have a predetermined configuration.

16. A contact terminal for a vehicular lamp in which a wedge base bulb is held by and electrically connects to the contact terminal, the contact terminal comprising:

a box-like terminal member;

a male contact piece projecting toward a back wall surface side of a lamp body; and a lamp body securing section disposed between said box-like terminal member and said male contact piece wherein said box-like terminal member has a front and a rear part and comprises a bottom plate which is L-shaped in vertical cross section, and a first and second flat side plates extending vertically from said bottom plate, said side plates holding first and second surfaces of a bulb base section of said bulb when said bulb is inserted at said front part, and a rear half part of each of said flat side plates is bent inward to overlap said bottom plate and form a rear wall.

17. The contact terminal according to claim 16, wherein a slit is defined between said bottom plate and each of said first and second flat side plates, so that a front half part of said bottom plate is slightly bent up inwardly and front half parts of each of said first and second flat side plates are bent back inwardly to form a first and a second bent back piece, respectively, and to define a bulb receiving chamber.

18. The contact terminal according to claim 17, wherein a tip end of said first bent-back piece of said first flat side plate is further bent to contact to said flat side plate.

19. The contact terminal according to claim 18, wherein said first bent-back piece of said first flat side plate comprises a rib extending in the front-rear direction, and said rib protrudes into said bulb receiving chamber.

20. The contact terminal according to claim 17, wherein said first first flat side plate comprises a claw formed at an inner end position of said bent-back piece of said flat side plate, and said claw is bent to protrude inward of said bulb receiving chamber.

21. The contact terminal according to claim 16, wherein a tip end part of said second flat side plate is divided relative to said bottom plate into upper and lower pieces by a slit extending in the front-rear direction of the lamp, each of said upper and lower pieces is bent back to have a respective predetermined angle with said second side plate so that tip ends of the bent-back pieces come closer to said first flat side plate.

22. The contact terminal according to claim 21, wherein said lower bent-back piece comprises at a distal end thereof an arcuate pressing section which protrudes into said bulb receiving chamber.

23. The contact terminal according to claim 21, wherein said upper bent-back piece comprises at a distal end thereof a claw engaging with said bulb.

24. The contact terminal according to claim 13, wherein said lamp body securing section of said contact terminal is notched at two portions at left and right outer periphery thereof, and a cut-out is defined in said securing section at a center of said securing section and in the widthwise direction thereof.

25. The contact terminal according to claim 13, wherein said male contact piece has a double layer structure which is formed by bending inwardly each of a left and right outer edge portion in a widthwise direction of the male contact piece forming region.

26. A method for molding a vehicular lamp, comprising steps of:

preparing a mold die;

preparing a contact terminal formed by bending a metal thin plate which is previously cut out to have a predetermined configuration including front and rear distal ends and a notched securing section at an intermediate part;

inserting said contact terminal in said mold die in such a manner that said front and rear distal ends of said contact terminal are exposed whereas said intermediate part is integrally molded in the lamp; and injecting a synthetic resin in the cavity of said mold die.

* * * * *